US006745922B1

(12) United States Patent
Vlooswijk et al.

(10) Patent No.: US 6,745,922 B1
(45) Date of Patent: Jun. 8, 2004

(54) CONTAINER FOR STORING AND DISPENSING BEVERAGE, IN PARTICULAR BEER

(75) Inventors: Johannes Jacobus Thomas Vlooswijk, Linschoten (NL); Guido Petrus Johannes van der Klaauw, Zoeterwoude (NL)

(73) Assignee: Heineken Technical Services B.V., Amsterdam (NL)

( * ) Notice: Subject to any disclaimer, the term of this patent is extended or adjusted under 35 U.S.C. 154(b) by 0 days.

(21) Appl. No.: 09/868,281

(22) PCT Filed: Dec. 14, 1999

(86) PCT No.: PCT/NL99/00770

§ 371 (c)(1),
(2), (4) Date: Sep. 4, 2001

(87) PCT Pub. No.: WO00/35803

PCT Pub. Date: Jun. 22, 2000

(30) Foreign Application Priority Data

Dec. 16, 1998 (DE) ..... 298 22 430 U
Aug. 10, 1999 (NL) ..... 1012802

(51) Int. Cl.[7] ..... B65D 83/00

(52) U.S. Cl. ..... 222/399; 222/396; 222/402.1; 222/575; 222/394; 239/346; 239/373

(58) Field of Search ..... 222/399, 402.1, 222/394, 396, 321.9, 575; 239/337, 339, 340, 346, 373

(56) References Cited

U.S. PATENT DOCUMENTS 2,694,602 A * 11/1954 Tomasek ..... 299/65
2,908,446 A * 10/1959 Strouse ..... 239/573
2,976,897 A * 3/1961 Beckworth ..... 141/17
3,148,806 A * 9/1964 Meshberg ..... 222/402.11
3,169,672 A * 2/1965 Soffer et al. ..... 222/163.11
3,240,403 A * 3/1966 Modderno ..... 222/399
3,245,435 A * 4/1966 Healy
3,258,163 A * 6/1966 Brush ..... 222/52
3,314,576 A * 4/1967 Focht et al. ..... 222/402.13
3,472,457 A * 10/1969 McAvoy ..... 239/337
3,613,954 A * 10/1971 Bayne ..... 222/399
3,815,793 A * 6/1974 Morane et al. ..... 222/399
3,976,221 A * 8/1976 Martin et al. ..... 222/61
3,992,493 A * 11/1976 Whyte et al. ..... 261/121.1
3,995,778 A * 12/1976 Gamadia ..... 222/399
4,049,158 A * 9/1977 Lo et al. ..... 222/95
4,078,705 A * 3/1978 Butcher ..... 222/402.24
4,147,283 A * 4/1979 Mascia et al. ..... 222/399
4,147,284 A * 4/1979 Mizzi ..... 222/401
4,162,765 A * 7/1979 Riccio ..... 239/337
4,174,811 A * 11/1979 Binder et al. ..... 239/308
4,202,470 A * 5/1980 Fujii ..... 222/130
4,310,108 A * 1/1982 Motoyama et al. ..... 222/396
4,471,893 A * 9/1984 Knickerbocker ..... 222/402.22

(List continued on next page.)

FOREIGN PATENT DOCUMENTS

| | | | | |
|---|---|---|---|---|
| DE | 4422190 | | 5/1995 | |
| EP | 0338844 | | 10/1989 | |
| FR | 2212510 | | 7/1974 | |
| FR | 2690142 | A1 * | 10/1993 | ..... B65D/83/26 |
| GB | 1044209 | | 9/1966 | |
| GB | 1440070 | * | 6/1976 | ..... B65D/83/14 |
| WO | WO 89 00544 | | 1/1989 | |

*Primary Examiner*—David A. Scherbel
*Assistant Examiner*—Frederick Nicolas
(74) *Attorney, Agent, or Firm*—Pearne & Gordon LLP

(57) ABSTRACT

A container for storing and dispensing beverage, in particular beer, which container comprises a top surface, while in the top surface a valve is provided for dispensing the beverage, and pressure means are provided in the inner space of the container for expelling the beverage from the container via the valve.

34 Claims, 3 Drawing Sheets

Figure 1A:
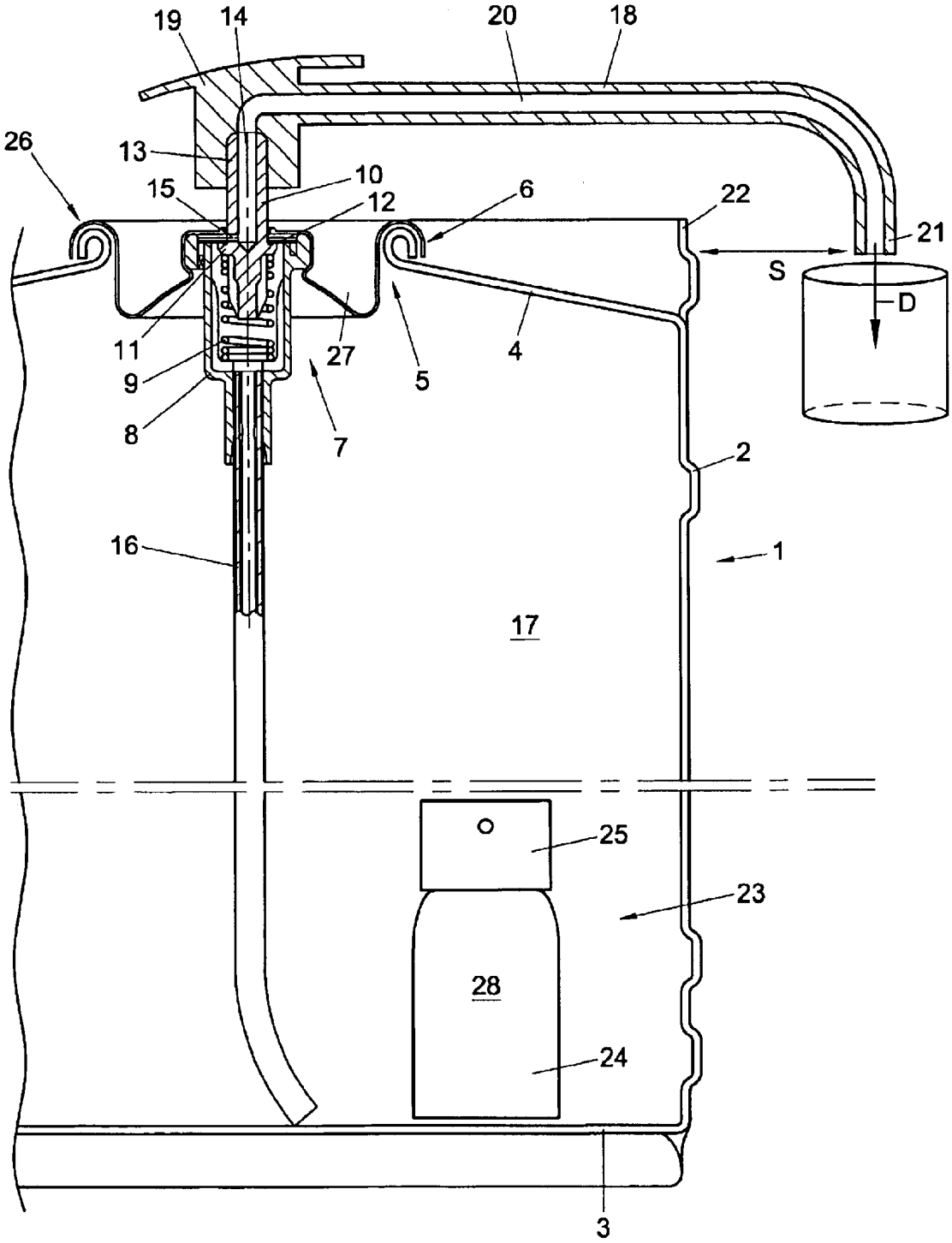

U.S. PATENT DOCUMENTS 4,762,254 A * 8/1988 Nitta ..... 222/402.24
5,129,552 A * 7/1992 Painchaud et al. ..... 222/146.6
5,326,002 A * 7/1994 Dubini ..... 222/402.1
D356,248 S * 3/1995 Wilkinson ..... D9/300
5,411,187 A * 5/1995 Schwab ..... 222/538
5,562,235 A * 10/1996 Cruysberghs ..... 222/396
6,360,923 B1 * 3/2002 Vlooswijk ..... 222/399
6,415,963 B1 * 7/2002 Vlooswijk et al. ..... 222/396

* cited by examiner

CONTAINER FOR STORING AND DISPENSING BEVERAGE, IN PARTICULAR BEER

This application was published in English on Jun. 22, 2000 as International Publication No. WO 00/35803.

This invention relates to a container for storing and dispensing beverage. This invention relates in particular to such a container for dispensing beer or a like carbonated beverage.

Beverages such as beer or other carbonated beverages are conventionally packed in containers such as kegs, cans and the like. Containers for packing and dispensing a series of consumptions are conventionally provided with a top surface having a central opening through which the beverage can be introduced into the container, which opening is subsequently closed with a cap. In the cap, a plug is provided which can be pressed or pulled from the cap. In the sidewall, adjacent the bottom of the container, a pour opening is provided, through which the beverage can be dispensed. In the pour opening, an extending or pivoting pouring tube with a tap or the like is provided, so that measured amounts of beverage can be dispensed. By removing the plug from the cap, evacuation of the inner space of the container is prevented. The beverage flows from the container under the influence of gravity.

These known containers have as a disadvantage that a pour opening, a tap or the like, and a pouring tube are to be provided, which renders the container costly. Moreover, in the use of such a container, there is the disadvantage that the container is to be placed high, or adjacent an edge of, for instance, a tabletop or the like, so as to enable a glass or mug to be held under the tap. In use, furthermore, there is a risk that the container is dislodged when the tap arranged on one side thereof is operated, in particular when the container is partly or substantially completely empty. Furthermore, these known containers have the disadvantage that the equilibrium pressure in the container is particularly dependent on the temperature. If carbonated beverage is dispensed from a relatively warm vessel, relatively much carbonic acid gas will disappear, giving rise to a high degree of foaming, while subsequent cooling of the container will have as a result that substantially no foaming will occur anymore.

It has previously been proposed to use containers in which a tapping rod can be inserted through the central opening in the top surface of the container, while an external pressure source such as a $CO_2$ cartridge can be connected for introducing a pressure gas into the container under simultaneous displacement of the beverage from the container via the tapping rod and a dispensing tube extending above the top surface. Optionally, by way of external pressure source, a hand-operated pumping means, such as bellows, may be provided, with air being used as pressure medium. However, such known apparatuses have as a disadvantage that a relatively complex and costly tapping rod with pressure device is to be employed, which is to be connected and set by a consumer prior to use. Such a tapping rod with pressure control device is to be purchased and maintained by the consumer, in particular to be cleaned after or prior to each use. Moreover, such a known device can entail danger to the consumer, for instance through improper use or incorrect setting, for instance in that a $CO_2$ cartridge may become detached from the pressure control device. A further disadvantage of these known apparatuses is that the central opening, prior to use, is closed by a readily removable cap, so that manipulation of the contents of the container is easily possible. As a consequence, the contents substantially cannot be guaranteed.

EP 0 338 844 discloses a container for storing and dispensing a liquid, comprising a spray can type valve in the top surface. This container is provided with pressure means connected to said container through a wall part thereof, which pressure means can be manually operated for raising the pressure inside said container for dispensing said liquid. A micro-porous membrane filter is provided inside said container, connected to said valve, for micro filtering said liquid to be dispensed, for filtering micro organisms from said liquid.

The object of the invention is to provide a container for storing and dispensing beverage, preferably beer, in which the above-mentioned disadvantages of the above-described known devices are obviated. To that end, a container according to the invention is characterized by the features hereinafter disclosed.

The use of a valve in the top surface of the container provides the advantage that a particularly simple and inexpensive sealing of the container is obtained, while manipulation of the contents of the container can be simply prevented. The use of pressure means included in the inner space of the container, with which beverage can be displaced from the container via the valve upon operation thereof, then provides the advantage that such a container is directly ready for use by a consumer. The consumer cannot access the pressure means proper, and does not need to, in fact cannot, set them, so that errors are avoided. Since the valve is placed in, at least adjacent to, the top surface of the container, a dispensing duct can be simply connected with the valve, which duct terminates at such a height above a setup surface for the container that a glass or the like can simply be held under it. The use of a valve for closing the container provides the advantage that the pressure in the container can be simply maintained and controlled, regardless of the degree of filling of the container.

The valve for use in a container according to the present invention is preferably a spray can valve as used, for instance, in aerosol containers and the like. Such valves, which are known in male, female and tilting designs, are known per se from practice. The use of such valves provides the advantage that they can be made of particularly reliable design, are relatively inexpensive in manufacture and use, and offer a high degree of safety. Surprisingly, it has been found that such valves are particularly suitable for dispensing beverage, in particular carbonated beverage, without giving rise to excessive foaming, while the operation of such valves is not adversely affected by the beverage.

A container according to the present invention is suitable in particular as a consumer package for beverage, in particular beer, and then preferably has a content of between 1 and 10 liters, more particularly between 3 and 7.5 liters. Such containers are relatively easy to handle for consumers and have a content which is conveniently adjusted to normal use by consumers during a "best before" term of the beverage in question. In addition, such a container, for instance of a content of about 4.5 to 5 liters, then provides the advantage that it can be stored, for instance, in a refrigerator. Moreover, such a device is suitable in particular as a (semi) professional package, for instance as a barrel having a content of between 10 and 50 liters, more particularly between 15 and 45 liters. Such a package provides the advantage that relatively large volumes of beverage can be made available, without necessitating large gas containers and associated pressure control devices to be placed separately from the barrel and to be connected. Such a barrel can, for instance, have a content of 15, 25 or 40 liters.

Further advantageous embodiments of a container according to the present invention are set forth in the dependent claims.

Figure 2:
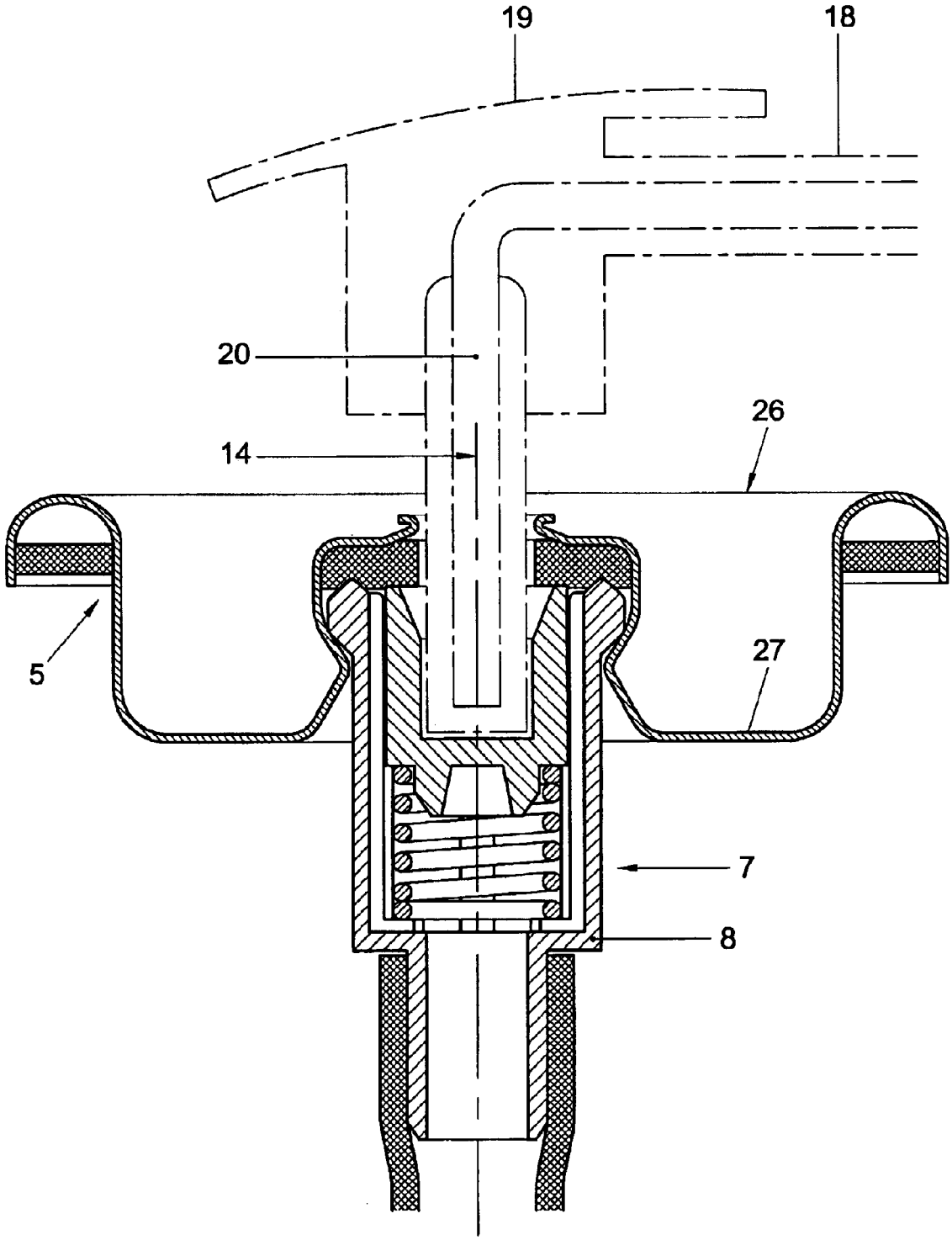

To clarify the invention, exemplary embodiments of a container according to the present invention will be described in more detail with reference to the drawings. In the drawings:

FIG. 2 shows a female-type valve for use in a container according to the invention.

Figure 1B:
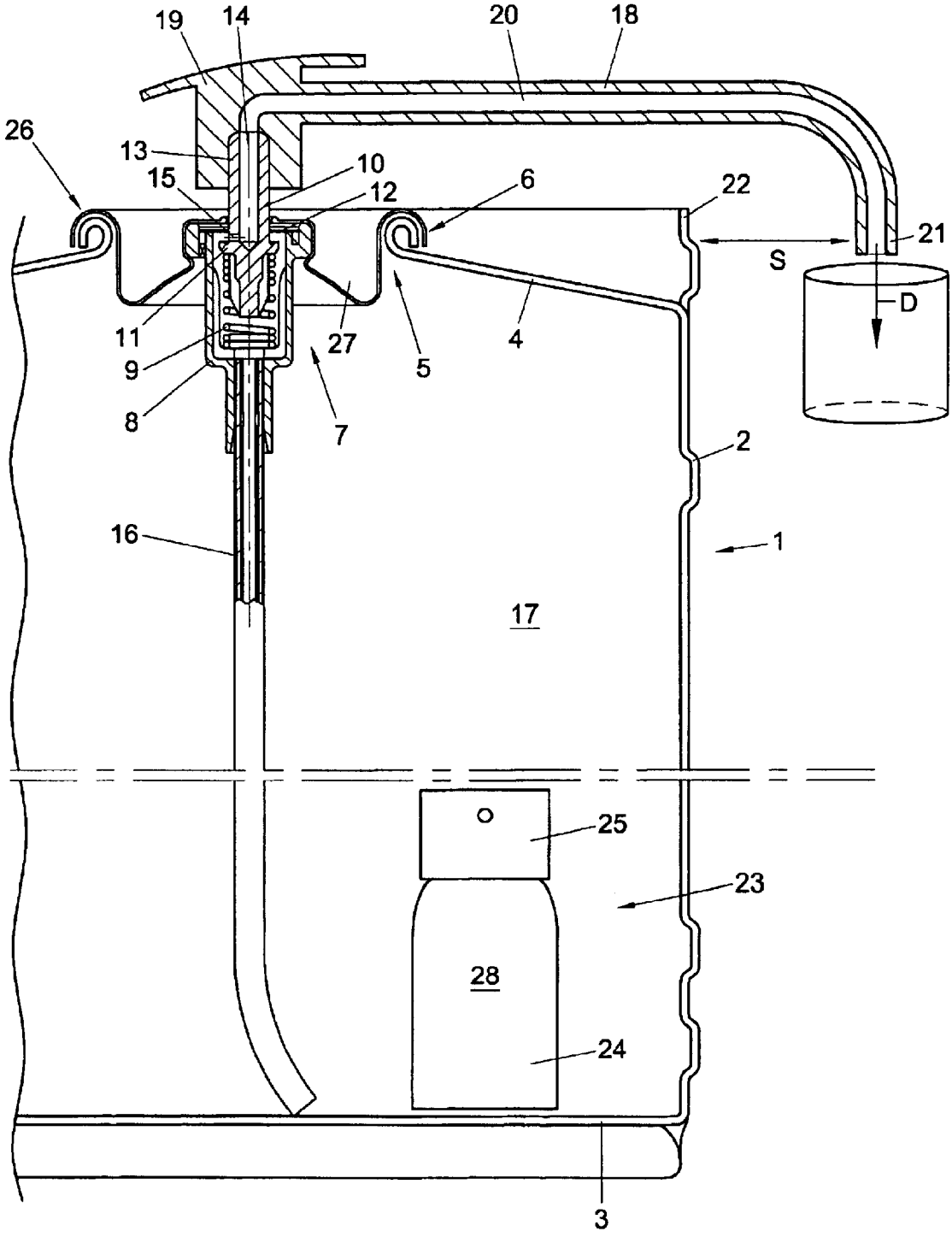

FIG. 1 shows a portion of a container 1 according to the invention, in side elevation, sectioned along a vertical longitudinal center plane. The container 1 comprises a cylindrical wall 2, a bottom 3 and a top surface 4 in which a central opening 5 is provided. In the central opening 5, a valve 7 is secured by means of a folded joint, which valve is a spray can valve, known per se, being the male variant in the embodiment shown. This valve 7 comprises a housing 8 in which a spring 9 is placed, which carries a valve body 10. The valve body 10 comprises a collar 11, which, when the valve is closed, rests against a sealing ring 12. A tubular part 13 of the valve body 10 extends outwardly and comprises a blind bore 14, whose bottom surface is at the level of the shoulder 11. At least one radial bore 15 is provided directly above the shoulder 11 and connects the blind bore 14 with the surroundings. When by means of the spring 9 the shoulder 11 is pressed against the sealing ring 12, the radial bore 15 is closed by the sealing ring 12. When the valve body 10 is moved down against the spring pressure 9, the radial bore 15 is rendered clear of the sealing ring 12, yielding a fluid communication between the inner-space of the housing 8 and the bore 14. From the lower end of the housing 8 extends a riser 16 (dip tube) as far as the bottom 3 of the container 1, allowing beverage to flow from the inner space 17 of the container 1 via the riser 16 to the housing 8. With the valve body 10 in the downwardly pressed position, the beverage can subsequently flow out via the radial bore 15 and the blind bore 14 of the valve 7.

On the valve body 10, a dispensing tube 18 is secured through an operating knob 19. The channel 20 in the dispensing tube 18 terminates at one end in the blind bore 14 and terminates at the other end in the end 21 of the dispensing tube 18. This end 21 is bent over in a downward direction, so that a substantially vertical outflow direction D is obtained. In the embodiment shown, the end 21 is located, for instance, approximately at the level of the shoulder 11, outside of the edge 22 of the container 1, at a distance S such that a glass can be simply held under the end 21.

In the inner space 17 of the container 1, pressure means 23 are arranged, comprising a holder 24 for a pressure gas, in particular $C0_2$, and a pressure control device 25 connected thereto. In the holder 24, preferably an adsorbing or absorbing medium 28 for the pressure gas is included, for instance activated carbon, such that at a relatively low pressure, a great deal of pressure gas such as $C0_2$ can be included. The pressure control device 25 is arranged for the controlled release of pressure gas from the holder 24, which is controlled depending on the pressure in the inner space 17. Such a pressure control is known, for instance, from FR-A-2,690,142, U.S. Pat. No. 4,310,108, or described in applicant's non-prepublished NL 1008601 and 1011570. These are understood to be incorporated herein by reference. The use of such a self-regulating pressure device provides the advantage that in a simple manner a desired pressure can be continuously maintained in the container 1, sufficiently high to enable beverage to be dispensed via the valve, while this valve can be placed in, at least adjacent to, the top surface 4. The use of a spray can valve 7 then provides the advantage that it is particularly simple in construction, functions highly reliably, and moreover ensures a particularly good sealing, so that even upon prolonged storage the pressure in the inner space 17 of the container 1 is maintained. Surprisingly, it has been found that the use of such a known valve with a relatively small radial opening 15 does not lead to excessive foaming or to an undesirably low tapping rate. Surprisingly, it has also been found that this relatively small radial opening does not become soiled unacceptably during the useful life of the container. Since the valve 7 is fixedly connected with the container 1 and is discarded along with it, there is no danger of repeated use. A further advantage of the use of a valve according to the invention is that manipulation of the contents in the inner space 17 of the container is substantially impossible due to the valve construction.

In the exemplary embodiment shown in FIG. 1, a sprayer valve of the male type is used. However, a sprayer valve of a female type can also be used. (See FIG. 2). This means that the bore 14 will extend at least substantially completely below the shoulder 11, that is, within the housing 8 of the valve 7. When such a valve is used, the knob 19 will be provided with a coupling pin which fits into the bore 14 and is provided with a portion of the channel 20. An advantage of such a female valve is that the valve 7 extends entirely below the upper edge 26 of the flange by which the valve 7 is secured in the opening 5 via the intermediate piece 27. With the knob 19 and dispensing tube 18 detached, unintentional opening of the valve is thereby prevented still better. It is preferred that a container 1 according to the invention is supplied with a detached knob 19 and dispensing tube 18, while the valve can be covered by a removable cap, preferably sealed.

A container 1 according to the invention can be filled through the opening 5, through which the pressure means 23 can also be introduced, before the valve 7 is secured in the opening 5. It is also possible, however, to fill the container 1 with beverage through the valve 7.

The invention is not limited in any manner to the embodiment shown in FIG. 1. Many variations thereof are possible.

Thus the valve 7 can be secured in the container in a is different way or at a different position, for instance in the sidewall, while the knob 19 and/or the dispensing tube 18 can be designed differently. Thus, for instance, the dispensing tube can be so designed that the end 21 extends at a relatively great distance above the top surface 4 of the container 1, so that a glass can be placed between the end and the top surface referred to. Any after-dripping beverage will then be received on the container 1. It will be clear that the container 1 can have any desired outer form and can be manufactured, for instance, from relatively thin tin, plastic or the like. A container 1 according to the invention is preferably used for storing and dispensing beer, but other beverages, which may or may not be carbonated, can also be received therein. The valve can optionally be designed as a tilting valve.

These and many comparable embodiments of a container are understood to fall within the framework of the invention as outlined by the claims.

What is claimed is:

1. A container for storing and dispensing a carbonated beverage, comprising a top surface, a spray can valve provided in said top surface, and pressure means provided in an inner space of the container for expelling said carbonated beverage from said container via the valve, said pressure means being arranged for the release of a pressure gas and comprising an adsorbing or absorbing medium for said pressure gas, said release of said pressure gas being controlled based on the pressure in said inner space, said container having a carbonated beverage therein, said container further comprising a dispensing tube secured to said valve, wherein an end portion of the dispensing tube is bent over in a downward direction, so that a substantially vertical outflow direction is obtained while the container remains in an upright position.

2. A container according to claim 1, wherein the valve is a female-type valve.

3. A container according to claim 1, wherein a detachable operating knob is provided for activating the valve, said dispensing tube being connected to said knob for dispensing said carbonated beverage to a position outside an outer edge of the top surface.

4. A container according to claim 1, wherein the valve extends substantially completely below a shoulder in the top surface in which the valve is positioned.

5. A container according to claim 1, wherein said spray can valve comprises an at least partly hollow tubular part which, through spring pressure, is biased in a closing direction against a closing ring, said tubular part further comprising at least one radial bore, said at least one radial bore providing fluid communication between said inner space and the environment when said tubular part is in an open position.

6. A container according claim 1, wherein the valve is connected with the top surface through a folded joint.

7. A container according to claim 5, further comprising an operating knob adapted to be pressed in the direction of the top surface, the valve thereby being pressed from a closed position to an open position, wherein upon release of the operating knob, the valve is pressed back into the closed position.

8. A container according to claim 1, wherein the valve is secured in a filling hole of the container.

9. A container according to claim 1, wherein the container has a capacity of between 1 and 10 liters.

10. A container according to claim 1, wherein the container has a capacity of between 10 and 50 liters.

11. A container according to claim 1, said carbonated beverage being beer.

12. A container according to claim 1, said pressure means being inaccessible to a consumer of said container.

13. A container according to claim 11, wherein the valve is a female-type valve.

14. A container according to claim 11, wherein said spray can valve comprises an at least partly hollow tubular part which, through spring pressure, is biased in a closing direction against a closing ring, said tubular part further comprising at least one radial bore, said at least one radial bore providing fluid communication between said inner space and the environment when said tubular part is in an open position.

15. A container according to claim 11, further comprising an operating knob adapted to be pressed in the direction of the top surface, the valve thereby being pressed from a closed position to an open position, wherein upon release of the operating knob, the valve is pressed back into the closed position.

16. A container according to claim 9, wherein said container has a capacity of between 3 and 7.5 liters.

17. A container according to claim 10, wherein said container has a capacity of between 15 and 45 liters.

18. A container according to claim 1, said medium for said pressure gas being activated carbon, said pressure gas being CO2.

19. A container according to claim 6, said valve extending substantially below said shoulder within a housing of said valve.

20. A container according to claim 9, wherein said container has a capacity of about 5 liters.

21. A container according to claim 1, said pressure gas providing dispensing pressure as a driving force for dispensing said carbonated beverage from said container to the environment when said valve is in an open position, said pressure gas also being at least partially dissolved in said carbonated beverage, said partially dissolved pressure gas providing carbonation to said carbonated beverage.

22. A container according to claim 1, said inner space having said carbonated beverage and a headspace over said carbonated beverage therein, said headspace having an equilibrium pressure of CO2 gas in equilibrium with a concentration of CO2 dissolved in said carbonated beverage, wherein said equilibrium pressure of CO2 gas in said headspace results in the desired concentration of dissolved CO2 in said carbonated beverage.

23. A container according to claim 22, said equilibrium pressure of CO2 gas in said headspace being regulated by said release of pressure gas by said pressure means.

24. A container for storing and dispensing a carbonated beverage, comprising a top surface, a spray can valve provided in said top surface, and pressure means provided in an inner space of the container for expelling said carbonated beverage from said container via the valve, said pressure means being arranged for the release of a pressure gas and comprising an adsorbing or absorbing medium for said pressure gas, said release of said pressure gas being controlled based on the pressure in said inner space, said container having a carbonated beverage therein, said container further comprising a dispensing tube secured to said valve, wherein the dispensing tube is substantially u-shaped.

25. A method of dispensing a carbonated beverage comprising the steps of:

providing a container comprising a spray can type valve and pressure means provided in an inner space of the container for expelling said carbonated beverage from said container via the valve, said pressure means being arranged for the release of a pressure gas and comprising an adsorbing or absorbing medium for said pressure gas, said release of said pressure gas being controlled based on the pressure in said inner space, said container further comprising a dispensing tube secured to said valve, and providing a carbonated beverage in said container, wherein the dispensing tube is substantially u-shaped.

26. A method according to claim 25, said carbonated beverage being beer.

27. A method according to claim 25, said pressure gas both:

a) providing dispensing pressure as a driving force effective to dispense said carbonated beverage from said container to the environment when said valve is in an open position; and b) being at least partially dissolved in said carbonated beverage, said partially dissolved pressure gas providing carbonation to said carbonated beverage.

28. A container for storing and dispensing a carbonated beverage, comprising a top surface, a spray can valve provided in said top surface, and pressure means provided in an inner space of the container for expelling said carbonated beverage from said container via the valve, said pressure means being arranged for the release of a pressure gas, said release of said pressure gas being controlled based on the pressure in said inner space, said container having a carbonated beverage therein, said container further comprising a dispensing tube secured to said valve, said valve comprising an at least partly hollow tubular part defining a central bore therein, said dispensing tube defining a dispensing channel therein, said central bore and said dispensing channel cooperating to form a u-shaped fluid passageway between said valve and the environment, said fluid passageway being substantially smooth and free from sudden changes in cross-section.

29. A container according to claim 28, wherein said tubular part, through spring pressure, is biased in a closed direction against a closing ring, said tubular part further comprising at least one radial bore, said at least one radial bore providing fluid communication between said inner space and the environment when said tubular part is in an open position.

30. A container according to claim 28, said pressure means comprising a an adsorbing or absorbing medium for said pressure gas.

31. A container according to claim 30, said medium for said pressure gas being activated carbon, said pressure gas being CO2.

32. A container according to claim 28, said pressure gas providing dispensing pressure as a driving force for dispensing said carbonated beverage from said container, said pressure gas also being at least partially dissolved in said carbonated beverage, said partially dissolved pressure gas providing carbonation to said carbonated beverage.

33. A container according to claim 28, wherein an end portion of the dispensing channel is directed downward at a distance from a top surface of the container.

34. A container according to claim 1, wherein an end portion of the dispensing tube is located at approximately a shoulder level, outside edge portion of the container such that a glass can be held under the end portion.

* * * * *